US007236072B2

(12) United States Patent
Grigorov

(10) Patent No.: US 7,236,072 B2
(45) Date of Patent: Jun. 26, 2007

(54) PASSIVE MAGNETIC LATCH

(75) Inventor: Ilya L. Grigorov, Los Angeles, CA (US)

(73) Assignee: Teledyne Technologies Incorporated, Thousand Oaks, CA (US)

( * ) Notice: Subject to any disclaimer, the term of this patent is extended or adjusted under 35 U.S.C. 154(b) by 1 day.

(21) Appl. No.: 11/001,302

(22) Filed: Dec. 1, 2004

(65) Prior Publication Data

US 2006/0114086 A1 Jun. 1, 2006

(51) Int. Cl.
*H01H 9/00* (2006.01)

(52) U.S. Cl. ..... 335/205; 335/207

(58) Field of Classification Search ..... 335/151–154, 335/205–207

See application file for complete search history.

(56) References Cited

U.S. PATENT DOCUMENTS

| | | | | |
|---|---|---|---|---|
| 3,440,583 | A * | 4/1969 | Woodhead | 335/154 |
| 3,489,971 | A * | 1/1970 | Robert | 335/207 |
| 3,559,124 | A * | 1/1971 | Posey | 335/205 |
| 3,967,224 | A | 6/1976 | Seeley | |
| 4,038,620 | A * | 7/1977 | Shlesinger et al. | 335/153 |
| 4,063,203 | A | 12/1977 | Fujiwara et al. | |
| 4,117,291 | A | 9/1978 | Gebauer | |
| 4,165,935 | A * | 8/1979 | Bongort et al. | 335/207 |
| 4,320,370 | A * | 3/1982 | Itou et al. | 335/208 |
| 4,943,791 | A * | 7/1990 | Holce et al. | 335/153 |
| 5,194,706 | A * | 3/1993 | Reneau | 200/61.45 R |
| 5,438,869 | A * | 8/1995 | Mueller et al. | 335/202 |
| 5,811,896 | A * | 9/1998 | Grad | 307/125 |
| 5,847,632 | A | 12/1998 | Oshima | |
| 5,883,556 | A | 3/1999 | Shutes | |
| 6,794,964 | B2 | 9/2004 | Sood et al. | |
| 2002/0149454 | A1 * | 10/2002 | Nishikawa | 335/205 |

FOREIGN PATENT DOCUMENTS

| | | |
|---|---|---|
| FR | 2457009 | 5/1979 |

* cited by examiner

*Primary Examiner*—Elvin Enad
*Assistant Examiner*—Bernard Rojas
(74) *Attorney, Agent, or Firm*—Kirkpatrick & Lockhart Preston Gates Ellis LLP

(57) ABSTRACT

A passive magnetic latch is disclosed. The latch includes, according to various embodiments, a magnetically-actuated switch and a hard, non-linear biasing magnet. The switch may include components that, when polarized, cause the switch to transition from a first state to a second state. The biasing magnet is positioned proximate to the switch such that when the magnetization of the biasing magnet is changed by an external effect to thereby induce a modified magnetic field from the biasing magnet, the modified magnetic field polarizes the components of the switch such that the switch transitions from the first state to the second state and remains in the second state after the external effect is removed. A second external effect may be used to again change the magnetization of the biasing magnet such that the components of the switch depolarize and the switch transitions back the first state. As such, the magnetic latch may act like a remote ON/OFF switch.

29 Claims, 5 Drawing Sheets

PASSIVE MAGNETIC LATCH

BACKGROUND

The present invention generally concerns latching devices (i.e., latches) and, more particularly, magnetic latches.

The most common element designed to provide ON/OFF switching action when activated magnetically is a reed switch. As shown in FIG. 1, a normally-open reed switch 28 generally consists of two beams 30 disposed in a hermetically sealed glass cover 33. The beams 30 are made of magnetically permeable (i.e., soft) metal placed in close proximity to each other with a small gap between the ends (or contacts) 32 of the beams 30. When magnetic field of proper configuration is applied to the device, the beams 30 polarize magnetically such that they attract and form a mechanical and electrical contact. When the field is removed, the beams return to the initial state such that there is no electrical contact between the beams.

In order to polarize the beams in magnetically opposite states (to cause attraction between the beams), the field around the beams should be highly non-uniform. This is usually achieved by placing a magnetically hard dipole magnet in the proximity of the switch. The hardness of the magnet is defined as its resistance to re-magnetization (high coercive force, Hc, and high remnant magnetization, Mr). The beams of the switch are, in turn, very soft magnetically, i.e. they have very low Hc and very low Mr. This condition insures consistent and linear mechanical action, and prevents self-latching.

Magnetic latching devices (or "magnetic relays") commonly include a reed switch. Such latching devices also typically include secondary solenoids which provide a field sufficient to retain the beams of the reed switch in the closed position, but insufficient to close the beams without an external field. Because the solenoids, however, require non-zero electrical current (or power), in circumstances when no such current can be provided, or it proves to be an excessive drain on a power supply, such magnetic latches are not practical for many applications. Accordingly, there exists a need for a passive magnetic latch.

SUMMARY OF THE INVENTION

In one general aspect, embodiments of the present invention are directed to a passive magnetic latch. The latch includes a magnetically-actuated switch and a hard, non-linear biasing magnet. The magnetically-actuated switch includes components that, when polarized, cause the magnetically-actuated switch to transition from a first state (such as open) to a second state (such as closed). According to various embodiments, the magnetically-actuated switch may be a reed switch with at least two soft magnetic beams that, when polarized, transition from the first state to the second state. The biasing magnet is positioned proximate to the reed switch such that when the magnetization of the biasing magnet is changed by an external effect to thereby induce a modified magnetic field from the biasing magnet, the modified magnetic field polarizes the beams of the reed switch such that the reed switch transitions from the first state to the second state and the reed switch remains in the second state after the external effect is removed. A second external effect may be used to change the magnetization of the biasing magnet causing de-polarization of the beams of the reed switch such that the switch transitions from the second state back to the first state and remains in the first state after the second external effect is removed. In this way, the passive magnetic latch may operate as a remote ON/OFF switch that is responsive to the external effects, which do not need to physically contact the biasing magnet, but merely need to suitably alter the magnetization of the biasing magnet.

The biasing magnet may be positioned a fixed distance from the magnetically-actuated (e.g., reed) switch. According to various implementations, the biasing magnet is directly connected to the magnetically-actuated switch by an adhesive. For example, the biasing magnet may be directly affixed to a glass cover of a reed switch with the adhesive. Also, the magnetically-actuated switch and the biasing magnet may be mounted on a substrate. Further, according to yet other embodiments, the magnetically-actuated switch and the biasing magnet may be fabricated as a monolithic structure.

The shape, structure, dimensions and position of the biasing magnet may be chosen to satisfy dimensional requirements as well as maximize or otherwise increase the sensitivity of the reed switch to the magnetization of the biasing magnet. According to one embodiment, the biasing magnet may be shaped such that it has multiple equivalent anisotropy axes (e.g., cubical or spherical). It may also be positioned, for example, at an axial end of the magnetically-actuated switch or adjacent to a mid-section portion of the magnetically-actuated switch.

The external effects on the biasing magnet may change, for example, the magnitude of the magnetization of the biasing magnet and/or the direction of the magnetization of the biasing magnet. According to various embodiments, the sources of the external effects may be external magnets, such as electromagnets or permanent magnets, that affect the magnetization of the biasing magnet. According to other embodiments, the sources of the external effects may be thermal sources capable of changing the fundamental properties of the biasing magnet material such as heating the biasing magnet above its Curie temperature.

DESCRIPTION OF THE FIGURES

Various embodiments of the present invention are described herein by way of example in connection with the following figures, wherein.

DETAILED DESCRIPTION OF THE INVENTION

Figure 1:
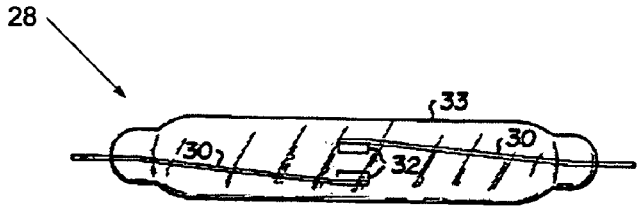
Fig. 1 (Prior Art)
FIG. 1 is a diagram of a prior art normally-open reed switch.
Figure 2:
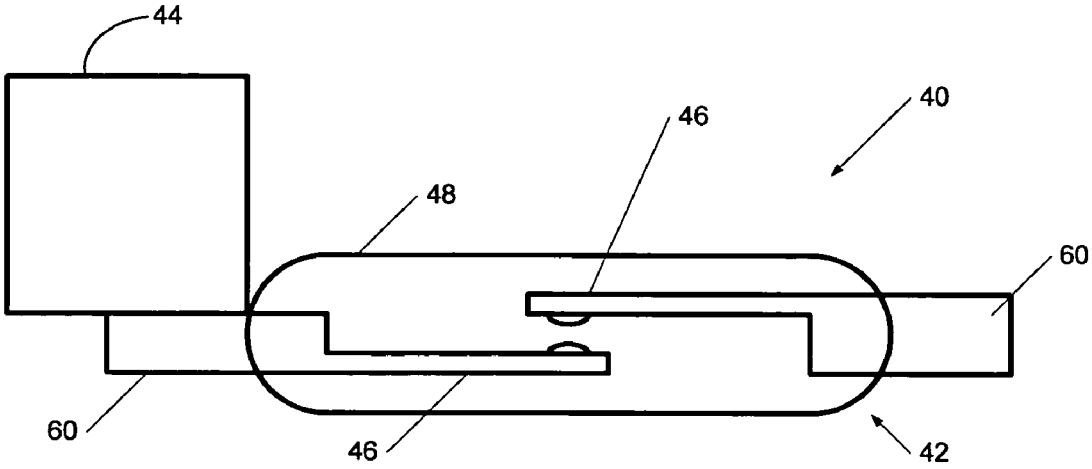
FIG. 2 is a side-view of a passive magnetic latch according to various embodiments of the present invention.
Figure 3:
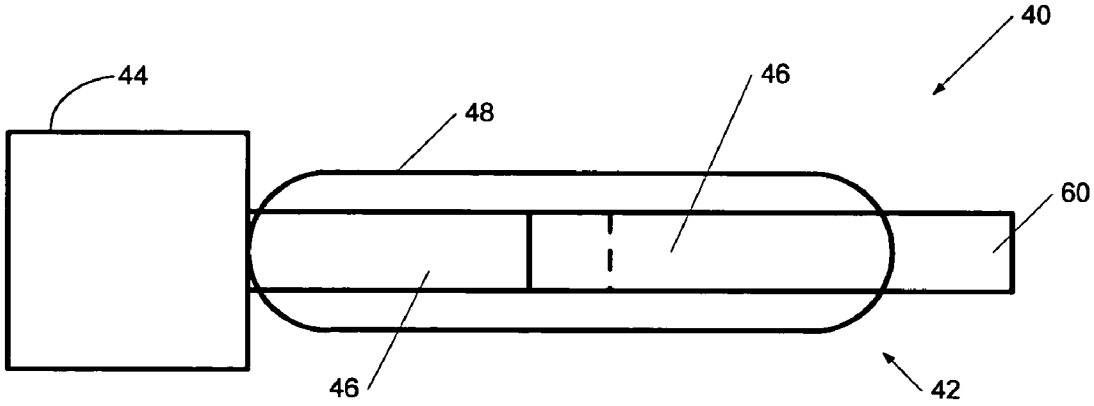
FIG. 3 is a top-view of the passive magnetic latch of FIG. 2 according to various embodiments of the present invention.

FIG. 2 is a side-view and FIG. 3 is a top-view of a passive magnetic latching device (or latch) 40 according to various embodiments of the present invention. As shown in these figures, the latching device 40 may include a magnetically-actuated switch 42 and a biasing magnet 44. The magnetically-actuated switch 42 may include components which, when polarized, cause the switch 42 to transition from a first state (such as open) to a second state (such as closed). According to various embodiments, the magnetically-actuated switch 42 may be, for example, a reed switch. The reed switch, as shown in FIGS. 2 and 3, may include a number of beams 46 made of a soft magnetic material, such as nickel, nickel-iron or nickel iron molybdenum based alloys, soft ferrites such as nickel-zinc or manganese-zinc ferrites, or combinations of these materials. The beams 46 may be configured such that there is a small gap between the contacts of the beams 46 in the absence of a polarizing magnetic field, i.e., an open state. As such, the reed switch may be a "normally-open" switch. When a suitable magnetic field is applied, the beams 46 polarize such that they attract and form a mechanical and electrical contact, i.e., a closed state. The beams 46 remain in the closed state until they are de-polarized.

According to other embodiments, the reed switch 42 may be a normally-closed switch. In that case, when a suitable polarizing magnetic field is applied, the beams polarize such that they repel and therefore break a mechanical/electrical contact between the beams, i.e., transition from a closed state to an open state. The beams 46 remain in the open state until depolarized. According to other embodiments, the magnetically-actuated switch 42 may assume other configurations, such as, for example, configurations that include three soft magnetic components.

The magnetically-actuated switch 42 will be described below as being a reed switch 42, although it should be recognized that any magnetically-actuated switch may be used. In addition, the reed switch 42 may or may not include a glass cover 48 enclosing the beams 46.

Figure 7:
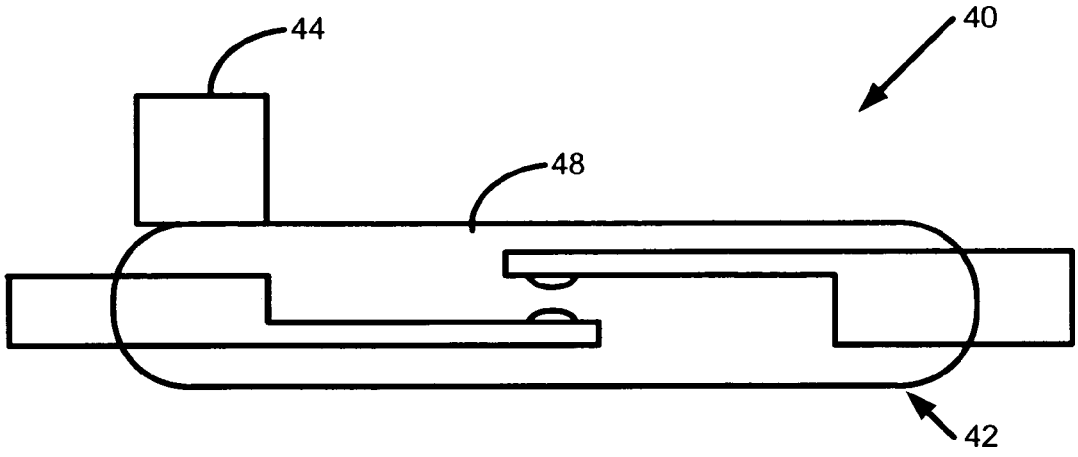

The biasing magnet 44 may be positioned proximate to and a fixed distance from the reed switch 42 such that the beams 46 are sensitive to the magnetization of the biasing magnet 44. For example, as shown in FIGS. 2 and 3 the biasing magnet may be directly connected to the reed switch 42, such as by affixing the biasing magnet 44 to the glass cover 48 of the reed switch 42 with an adhesive, as shown in FIG. 7. In other embodiments, as described below, the biasing magnet 44 may not be directly attached to the reed switch 42, yet still sufficiently proximate to the reed switch 42 such that the beams 46 are sensitive to the magnetization of the biasing magnet 44.

The biasing magnet 44 is made of a hard (or permanent), non-linear ferromagnetic material, such as iron, nickel, cobalt, alloys thereof (including Alcino alloys), SmCo based alloys, NdFeB based alloys, hard ferrites such as strontium ferrite, hard magnetic polymer composites or combinations of these materials. The biasing magnet 44 may produce a non-uniform magnetic field. The field may be insufficient to polarize the beams 46 of the reed switch 42 in the absence of an external effect that changes the magnetization of the biasing magnet 44. As such, if the reed switch 42 is a normally-open switch, the contact between the beams 46 will remain open until the biasing magnet 44 is appropriately magnetized by the external effect.

The non-linearity of the biasing magnet 44 is exhibited in its hysteretic behavior: the biasing magnet 44 retains a non-zero magnetization in the absence of an external field or other external effect on the magnetization of the biasing magnet 44, and requires the application of a non-zero external field to either eliminate or reduce the macroscopic magnetization thereof, or to rotate the direction of the magnetization of the biasing magnet 44. The hysteresis of the biasing magnet 44 is affected by the structure and shape of the biasing magnet 44. The internal structure, including the granularity, defines the intrinsic direction of the magnetic anisotropy (i.e., preferred direction of magnetization), the saturated magnetic moment, and the remnant magnetization of the biasing magnet 44. The shape of the biasing magnet 44 defines its shape anisotropy, i.e., the preferred direction of the remnant magnetization due to the demagnetization in its own field.

In operation, the initial magnetization of the biasing magnet 44, in the absence of an external effect on the magnetization thereof, may be insufficient to cause the beams 46 of the reed switch to polarize and cause the reed switch 42 to change states (e.g., open-to-closed or closed-to-open). When a sufficient external effect (either uniform or non-uniform), however, is applied to the biasing magnet 44, the magnetization of the biasing magnet 44 is changed. The change may be, for example, a change in the magnitude of the magnetization and/or a change in the direction of magnetization with respect to the axis of the switch 42, and the change in magnetization of the biasing magnet 44 causes the new, or modified, magnetic field from the biasing magnet 44 to be sufficient to polarize the beams 46 to change the state of the reed switch 42, even after the external effect is removed. Therefore, since only the magnetization state of the biasing magnet 44 affects the state of the switch 42, the effect of the external field on the latching device 40 is transitory.

Figure 4:
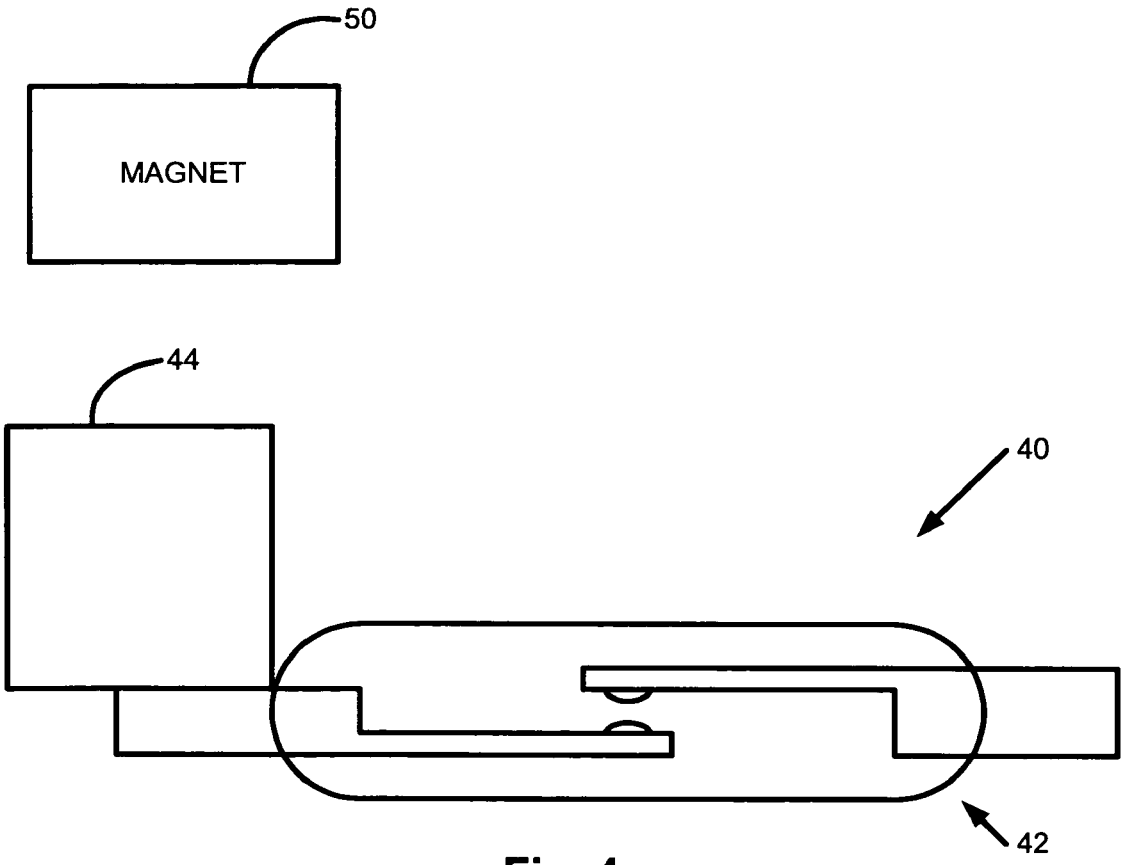
FIGS. 4-7 are diagrams of the passive magnetic latch according to other various embodiments of the present invention.
Figure 5:
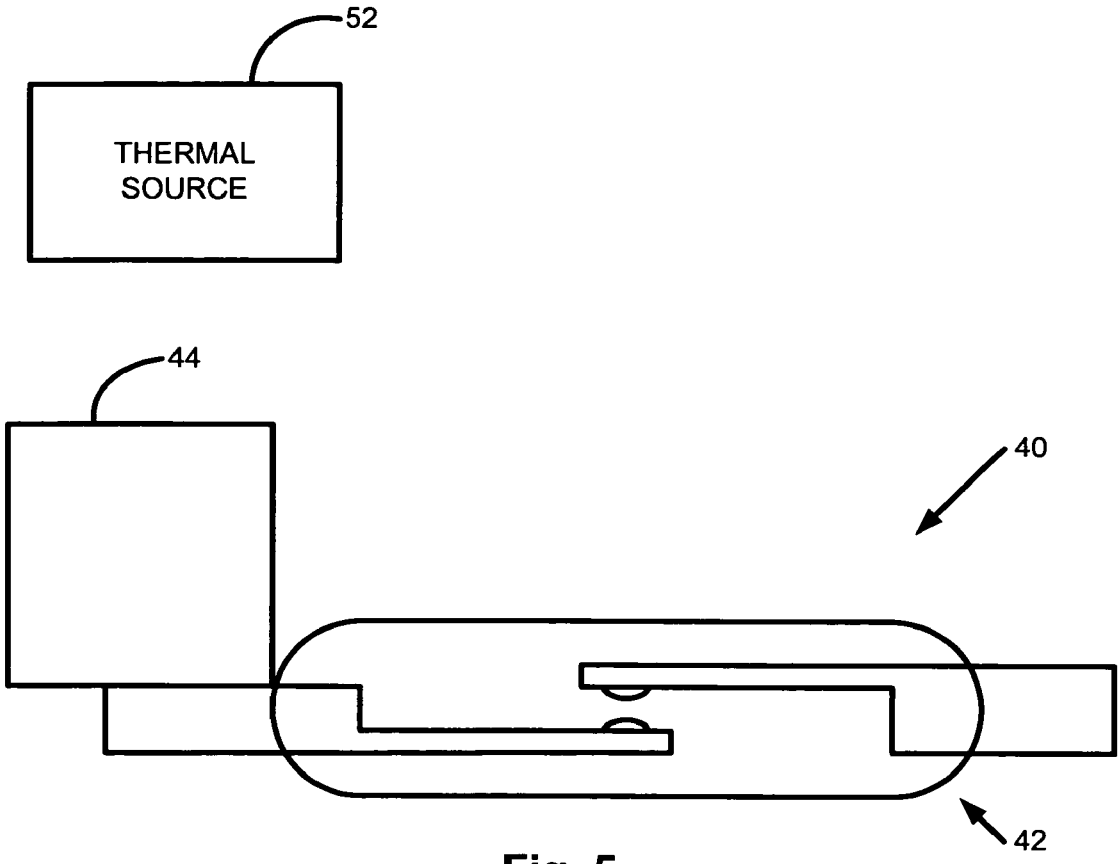

The external effect may be, for example, a magnetic field produced by a magnet 50 placed sufficiently near to the biasing magnet 44, shown in FIG. 4. The magnet 50 may be, for example, a permanent magnet or an electromagnet. Also, as shown in FIG. 5, the external effect may be thermal energy from a thermal source 52 that affects the fundamental magnetic state of the magnet material by (for example) heating or cooling the biasing magnet 44 through its Curie temperature. The thermal source 52 may be, for example, a resistive heating element or a thermo-electric cooler (TEC). Also, the external effect may be, for example, a combination of temperature and a magnetic field. In that case, the thermal source 52 need only heat the biasing magnet 44 to a temperature near its Curie temperature, and not necessarily above it. For magnets with multiple magnetic sub-systems (i.e., ferrimagnets, etc.), the thermal effect may be heating or cooling the biasing magnet 44 to a compensation temperature. The external effect may magnetize the biasing magnet 44 such that the biasing magnet 44 is biased along the axis of the reed switch 42.

A second external effect may be used to transition the switch 42 from the second state back to the first state. In order to accomplish this, the second external effect may again change the magnetization of the biasing magnet 44 (either by changing the magnitude and/or direction of the magnetization) to cause the beams 46 to de-polarize, thereby causing the beams 46 to revert back to the first state. For example, for a normally-open switch, the change in magnetization of the biasing magnet 44 caused by the second external effect may cause the beams 46 to repel each other such that the switch 42 transitions to an open state. For a normally-closed switch, the change in magnetization of the biasing magnet 44 caused by the second external effect may cause the beams 46 to attract each other such that the switch 42 transitions to a closed open state.

Like the first external effect, the second external effect may be produced by an external magnetic field produced by an external magnet (not shown), such as either a permanent magnet or an electromagnet, and/or thermal flow from an external thermal source (not shown) that is sufficient to heat or cool the biasing magnet 44 to its critical temperature (Curie temperature or compensation temperature).

Figure 6:
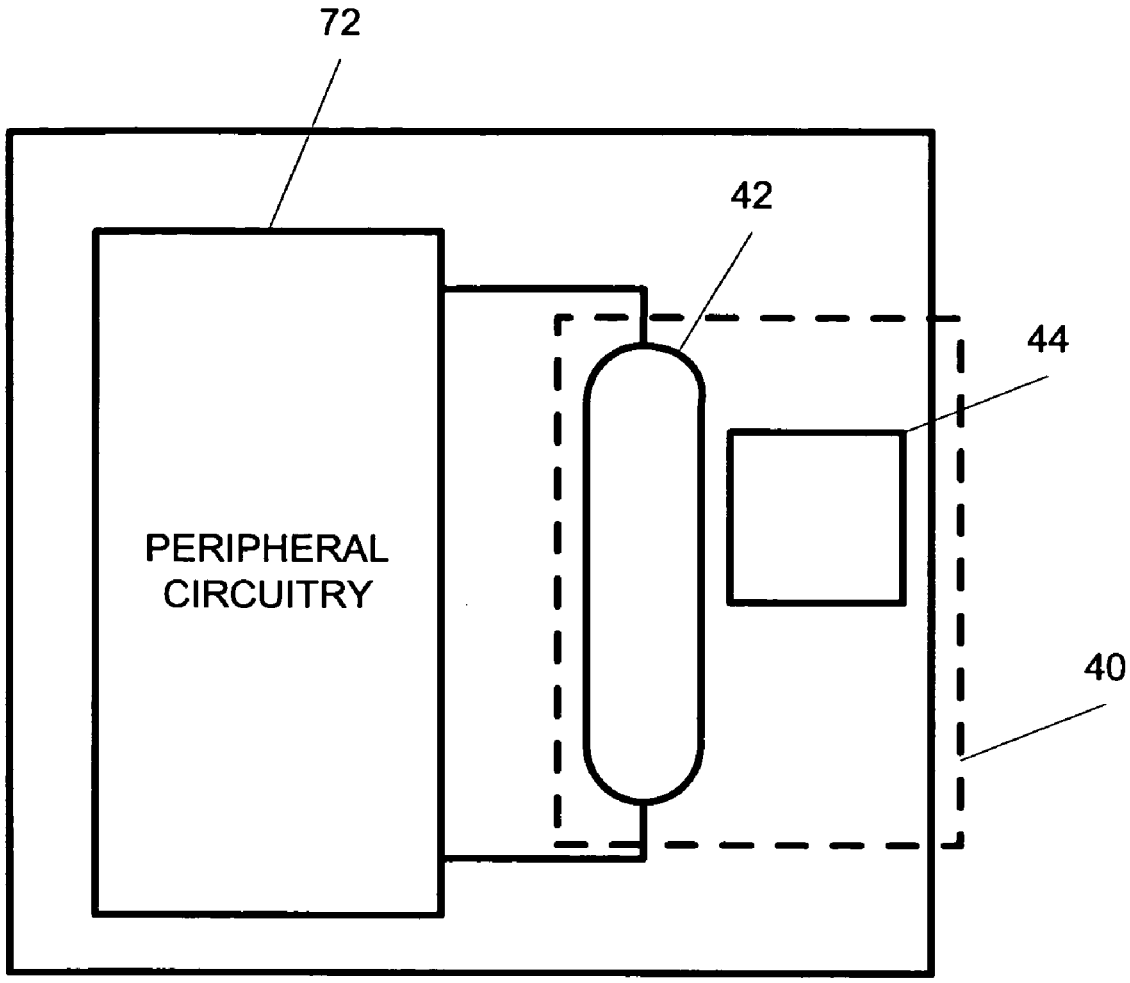

The biasing magnet 44 may be of comparable size to the reed switch 42. In order to increase the sensitivity of the reed switch 42 to the biasing magnet 44, the biasing magnet 44 may be positioned in a location where the switch 42 shows maximum sensitivity to the field of the biasing magnet 44. This location may vary depending on the type and model of reed switch 42 used. For example, reed switches that are less sensitive may require larger biasing magnets placed closer to the reed switch, and more sensitive reed switches may permit the use of smaller biasing magnets positioned further from the reed switch. Also, the biasing magnet 44 may be fabricated to be intrinsically isotropic and shaped to avoid strong shape anisotropy. For example, the biasing magnet 44 may be shaped such that it has multiple equivalent anisotropy axes. For example, the biasing magnet 44 may be cubical or spherical in shape. The biasing magnet 44 may be positioned at one axial end of the reed switch 42, as shown in FIGS. 2 and 3, or, for example, it may be positioned adjacent to a mid-section portion of the reed switch, as shown in FIG. 6. Indeed, the biasing magnet 44 may be positioned relative to the switch 42 in any position in which the switch 42 exhibits adequate sensitivity to the magnetization of the biasing magnet 44.

In other embodiments, as shown in FIG. 6, the biasing magnet 44 and the reed switch 42 may be mounted to a substrate 70 such that the biasing magnet 44 is not directly connected to the reed switch 42, yet still sufficiently proximate to the reed switch 42 such that the reed switch 42 is sensitive to the magnetization of the biasing magnet. Alternatively, the biasing magnet 44 and reed switch 42 may be mounted to the substrate 70 such that they are in direct contact. In yet other embodiments, rather than being discrete components, the biasing magnet 44 and the switch 42 may be fabricated as part of a monolithic structure.

FIG. 6 also shows peripheral circuitry 72 coupled to the reed switch 42. Accordingly, the magnetic latch 40 may perform like a remote ON/OFF switching device for the peripheral circuitry 72. That is, the external effects could be used magnetize/demagnetize the biasing magnet 44 and thereby activate/deactivate the switch 42 (e.g., change states) without direct contact between the sources of the external effects and the latch device itself. The switch 42 may then be used to turn on and off the peripheral circuitry 72.

In commercial applications, the magnetic latch device 40 may be produced, for example, as a combination of the biasing magnet 44 and the reed switch 42 (as shown, for example, in FIGS. 2, 3 and 6), or the latch 40 may be coupled in a commercial package with the sources for the external effects on the magnetization of biasing magnet, such as electromagnets 50, as shown in FIG. 4, and/or thermal sources 52, as shown in FIG. 5. Also, as described above, the magnetic latch device may be part of a monolithic structure. For example, the magnetically-actuated switch 42, the biasing magnet 44, and at least one of the sources of the first and second external effects may fabricated such that they are part of a monolithic structure.

The present invention is also directed to methods of remotely activating (or actuating) a magnetically-actuated (e.g., reed) switch 42. According to various embodiments, the method includes positioning a hard, non-linear biasing magnet 44 proximate to the reed switch 42 such that the reed switch is sensitive to the magnetization of the biasing magnet 44. The method also includes changing the magnetization of the biasing magnet 44 with an external effect such that when the magnetization of the biasing magnet 44 is changed by the external effect to thereby induce a modified magnetic field from the biasing magnet 44, the modified magnetic field polarizes the beams 46 of the reed switch 42 such that the reed switch 42 transitions from a first state to a second state and the reed switch 42 remains in the second state after the external effect is removed. Changing the magnetization of the biasing magnet may include changing the magnitude and/or the direction of the magnetization of the biasing magnet 44.

The method may further include changing the magnetization of the biasing magnet 44 with a second external effect such that the magnetization of the biasing magnet 44 causes the beams 46 to depolarize and thereby revert back to the first state. Again, changing the magnetization of the biasing magnet 44 with the second external effect may include changing the magnitude and/or the direction of the magnetization of the biasing magnet 44

While several embodiments of the invention have been described herein, it should be apparent, that various modifications, alterations and adaptations to those embodiments may occur to persons skilled in the art with the attainment of some or all of the advantages of the present invention. For example, different materials for some of the components may be used that those describes above. It is therefore intended to cover all such modifications, alterations and adaptations without departing from the scope and spirit of the present invention as defined by the appended claims.

What is claimed is:

1. A passive magnetic latch, comprising:

a magnetically-actuated switch including components which, when polarized, cause the magnetically-actuated switch to transition from a first state to a second state; and a hard, non-linear biasing magnet having multiple anisotropy axes positioned proximate to the magnetically-actuated switch such that when an external effect is applied to the biasing magnet the magnetization of the biasing magnet is rotated and the magnitude of the magnetization is changed such that the change in direction and magnitude of the magnetization polarizes the components of the magnetically-actuated switch such that the magnetically-actuated switch transitions from the first state to the second state and the magnetically-actuated switch remains in the second state after the external effect is removed.

2. The passive magnetic latch of claim 1, wherein the magnetically-actuated switch includes a reed switch having at least two soft, magnetic beams that, when polarized, cause the reed switch to transition from the first state to the second state.

3. The passive magnetic latch of claim 1, wherein when the magnetization of the biasing magnet is changed by a second external effect to thereby induce a second modified magnetic field from the biasing magnet, such that the second modified magnetic field de-polarizes the components of the magnetically-actuated switch such that the magnetically-actuated switch transitions from the second state to the first state, and remains in the first state after the second external effect is removed.

4. The passive magnetic latch 1, wherein the biasing magnet is positioned a fixed distance from the magnetically-actuated switch.

5. The passive magnetic latch of claim 1, wherein the biasing magnet is directly connected to the magnetically-actuated switch by an adhesive.

6. The passive magnetic latch of claim 5, wherein:

the magnetically-actuated switch includes a reed switch; and the biasing magnetic is directly connected to a glass cover of the reed switch by the adhesive.

7. The passive magnetic latch of claim 1, wherein the magnetically-actuated switch and the biasing magnet are mounted on a substrate.

8. The passive magnetic latch of claim 1, wherein the biasing magnet has multiple equivalent anisotropy axes.

9. The passive magnetic latch of claim 1, wherein the biasing magnet is positioned at an axial end of the magnetically-actuated switch.

10. The passive magnetic latch of claim 1, wherein the biasing magnet is positioned adjacent to a mid-section portion of-the magnetically-actuated switch.

11. The passive magnetic latch of claim 1, wherein the external effect includes an external magnetic field produced by an external magnet.

12. The passive magnetic latch of claim 1, wherein the external effect includes at least one of heating or cooling the biasing magnet to at least a temperature near its critical temperature.

13. The passive magnetic latch of claim 1, wherein the magnetically-actuated switch and the biasing magnet are part of a monolithic structure.

14. The passive magnetic latch of claim 1, further comprising:

a first source of a first external effect for changing the direction and magnitude of the magnetization of the biasing magnet such that when the direction and magnitude of the magnetization of the biasing magnet is changed by the first external effect to thereby induce a modified magnetic field from the biasing magnet, such that the change in direction and magnitude of magnetization polarizes the components of the magnetically-actuated switch such that the magnetically-actuated switch transitions from the first state to the second state and the magnetically-actuated switch remains in the second state after the external effect is removed.

15. The passive magnetic latch of claim 14, wherein the first source of the first external effect includes a magnet.

16. The passive magnetic latch of claim 15, wherein the magnet includes an electromagnet.

17. The passive magnetic latch of claim 14, wherein the first source of the first external effect includes a thermal source for at least one of heating or cooling the biasing magnet at least to a temperature near its critical temperature.

18. The passive magnetic latch of claim 14, wherein the magnetically-actuated switch includes a reed switch having at least two soft, magnetic beams that, when polarized, cause the reed switch to transition from the first state to the second state.

19. The passive magnetic latch of claim 14, further comprising a source of a second external effect, such that when the direction and magnitude of the magnetization of the biasing magnet is changed by the second external effect to thereby induce a second modified magnetic field from the biasing magnet, the second modified magnetic field de-polarizes the components of the magnetically-actuated switch such that the magnetically-actuated switch transitions from the second state to the first state, and remains in the first state after the second external effect is removed.

20. The passive magnetic latch of claim 19, wherein:

the first source includes at least one of a magnet or a heat source; and the second source includes at least one of a magnet or a heat source.

21. The passive magnetic latch of claim 19, wherein the magnetically-actuated switch, the biasing magnet, and at least one of the sources of the first and second effects are part of a monolithic structure.

22. A method of activating a magnetically-actuated switch, comprising:

positioning a hard, non-linear biasing magnet having multiple anisotropy axes proximate to the magnetically-actuated switch; and applying a first external effect to the biasing magnet to change the magnitude of the magnetization of the biasing magnet and to rotate the magnetization of the biasing magnet such that when the direction and magnitude of the magnetization of the biasing magnet is changed by the first external effect, the change in direction and magnitude of the magnetization polarizes the components of the magnetically-actuated switch such that the magnetically-actuated switch transitions from a first state to a second state and the magnetically-actuated switch remains in the second state after the external effect is removed.

23. The method of claim 22, wherein the first external effect includes a magnetic field.

24. The method of claim 23, wherein the magnetic field includes an electromagnetic field.

25. The method of claim 22, wherein the first external effect includes thermal flow sufficient to at least one of heat or cool the biasing magnet to at least a temperature near its critical temperature.

26. The method of claim 22, further comprising changing the direction and magnitude of the magnetization of the biasing magnet with a second external effect such that when the direction and magnitude of the magnetization of the biasing magnet is changed by the second external effect to thereby induce a second modified magnetic field from the biasing magnet, the change in direction and magnitude of the magnetization de-polarizes the components of the magnetically-actuated switch such that the magnetically-actuated switch transitions from the second state to the first state and the magnetically-actuated switch remains in the first state after the second external effect is removed.

27. The method of claim 22, wherein the external effect is applied by a magnet.

28. The method of claim 27, wherein the magnet applying the external effect is an electromagnet.

29. The method of claim 28, wherein the electromagnet is a fixed distance from the biasing magnet.

* * * * *